US006182313B1

(12) United States Patent
Eschenbach

(10) Patent No.: US 6,182,313 B1
(45) Date of Patent: Feb. 6, 2001

(54) THERAPEUTIC HEAD CRADLE

(76) Inventor: Paul William Eschenbach, 143 Lakeland Ave., Moore, SC (US) 29369

( * ) Notice: Under 35 U.S.C. 154(b), the term of this patent shall be extended for 0 days.

(21) Appl. No.: 09/273,796

(22) Filed: Mar. 22, 1999

(51) Int. Cl.[7] ..... A47C 20/02; A47G 9/10

(52) U.S. Cl. ..... 5/640; 5/643; 5/637; 5/639; 5/906

(58) Field of Search ..... 5/636, 637, 638, 5/639, 640, 643, 904, 906, 933

(56) References Cited

U.S. PATENT DOCUMENTS

| | | | | |
|---|---|---|---|---|
| 2,556,629 | * | 6/1951 | O'Brien | 5/643 X |
| 3,140,497 | * | 7/1964 | Carswell | 5/643 X |
| 3,574,397 | | 4/1971 | Norriss | 297/391 |
| 3,694,831 | * | 10/1972 | Treace | 5/638 |
| 3,829,917 | | 8/1974 | Delaittre | 5/338 |
| 4,285,081 | | 8/1981 | Price | 5/434 |
| 4,319,574 | | 3/1982 | Sun et al. | 128/303 |
| 4,330,892 | * | 5/1982 | Fukushima | 5/906 X |
| 4,424,599 | | 1/1984 | Hannouche | 5/436 |
| 4,452,237 | | 6/1984 | Lewis | 128/60 |
| 4,479,495 | | 10/1984 | Isaacson | 128/327 |
| 4,520,798 | | 6/1985 | Lewis | 128/24 |
| 4,574,787 | | 3/1986 | Jacobs | 128/64 |
| 4,660,239 | | 4/1987 | Thomas | 5/434 |
| 4,756,055 | * | 7/1988 | Beier | 5/437 |
| 4,768,246 | | 9/1988 | Summer | 5/434 |
| 4,850,067 | | 7/1989 | Latorre | 5/431 |
| 4,899,405 | | 2/1990 | Rothbard | 5/434 |
| 4,914,763 | * | 4/1990 | Clark | 5/440 |
| 4,918,774 | * | 4/1990 | Popitz | 5/441 |
| 5,025,518 | | 6/1991 | Summer | 5/434 |
| 5,129,705 | | 7/1992 | Wray | 297/397 |
| 5,193,236 | * | 3/1993 | Komura | 5/906 X |
| 5,257,429 | * | 11/1993 | Genis | 5/636 |
| 5,360,017 | * | 11/1994 | Austin | 128/845 |
| 5,396,674 | * | 3/1995 | Bolds | 5/643 X |
| 5,457,832 | | 10/1995 | Tatum | 5/636 |
| 5,479,667 | * | 1/1996 | Nelson et al. | 5/904 X |
| 5,481,771 | | 1/1996 | Burk | 5/636 |
| 5,545,177 | | 8/1996 | Coseo | 606/204 |
| 5,569,166 | | 10/1996 | Stone | 601/21 |
| 5,607,749 | | 3/1997 | Strumor | 428/156 |
| 5,615,432 | | 4/1997 | Von Ohlen | 05/638 |
| 5,630,651 | | 5/1997 | Fishbane | 297/397 |
| 5,682,633 | | 11/1997 | Davis | 05/636 |
| 5,708,999 | | 1/1998 | Priolo | 5/644 |
| 5,713,816 | | 2/1998 | Glover | 482/10 |
| 5,727,267 | | 3/1998 | Keilhauer | 5/636 |
| 5,779,652 | | 7/1998 | Mencher-Aliazzo | 601/132 |
| 5,792,174 | | 8/1998 | Ioan | 606/201 |
| 5,813,065 | | 9/1998 | Tinhorn | 5/639 |
| 6,023,801 | * | 2/2000 | Lamm | 5/636 |

OTHER PUBLICATIONS

Accupressure's Potent Points—by Michael Reed Gach Bantam Books, New York 1990.

Guide to Acupressure by James Roy Holliday, III http:cc.ukans.edul~moriarty/acupressure/acuguide.html.

Chinese Self–Massage by Fan Ya–Li Blue Poppy Press, Boulder, CO 1997.

Tao Shiatsu—Life Medicine for the Twenty First Century by Ryokyn Endo, Japan Pub., New York 1995 http://Holisticonline.com.

* cited by examiner

*Primary Examiner*—Michael Trettel

(57) ABSTRACT

A therapeutic head cradle apparatus has a pair of lateral side support members positioned to support the back, front or side of the head. Weight of the head will apply acupressure and shiatsu pressure to various pressure points located in the head area. Elastomeric cushion layers of different densities allow Chinese self-massage while the head is rolled side to side. A means to adjust the distance between the lateral support members is provided. Magnetic therapy and a sound system may also be part of the head cradle apparatus.

14 Claims, 10 Drawing Sheets

A

B

C

D

E

THERAPEUTIC HEAD CRADLE

BACKGROUND OF THE INVENTION

1. Field

The present invention relates to therapeutic head cradle apparatus intended to support the back, front or side of head to apply acupressure and shiatsu to portions of the head resulting from contact with the head cradle. The head cradle can be used in a prone body or inclined body position. Elastomeric cushion covers lateral support members of the head cradle to provide self-massage when the head is rolled side to side.

2. State of the Art

The benefits of Acupressure, Shiatsu and Chinese self-massage to relieve stress, tension, insomnia, headaches, anxiety and other symptoms is well documented in the literature. Acupressue deals with the application of pressure to certain meridian points on the body to relieve pain. The human body has fourteen meridians that carry energy throughout the body according to James Roy Holliday, III in his "Guide to Acupressure" on the internet.

The meridians start at the fingertips, connect to the brain, and then connect to the organ associated with the specific meridian. Acupressue is applied locally to a small area of the body at pressure points using the thumb, finger, knuckle or probes. Thirty-two pressure point areas are given by James Roy Holliday, III where five areas are located about the head. One pair is found on either side of the head where the spine meets the skull. A second pair is found on the back of the jawbone just below the ear. The third pair is located on the cheek, next to the outside of the nostril. A fourth and fifth pair are located among the eyebrows.

Michael Reed Gach in the book "Acupressure's Potent Points—A Guide to Self-Care for Common Ailments", Bantam Books, New York, 1990, deals with the application of self-acupressure to common pressure points and other areas of the body to treat common ailments. The present invention provides a head cradle that permits the application of acupressure at all five pressure points as the head and body are moved into back, side and frontal contact with the head cradle.

Shiatsu is similar to acupressure in that pressure is applied to the pressure points on the meridian but over a larger surface area. Shiatsu is commonly applied with the palm, elbow, knee, and foot. Often a holding technique is used to maintain pressure for a longer period of time. Shiatsu combines pressure and stretching techniques to stimulate the circulation and flow of lymphatic fluid to release toxins and release tensions according to the internet address http://Holisticonline.com. Benefits include reduced stress and fatigue, increased circulation of blood and lymph fluids, reduced blood pressure and less muscle stiffness. Ryokyn Endo in the book "Tao Shiatsu-Life Medicine for the Twenty-First Century", Japan Publications, Inc., Toyoko and New York, 1995, page 62 describes the basic techniques using the palm, heel of the hand and other pressure application methods of Shiatsu. He describes the importance of continuous steady pressure for Shiatsu on page 79. The present invention can provide pressure to the head over surface areas larger than the pressure points for a combined application of Shiatsu and Acupressure. Stretching techniques can be added as optional for more complete Shiatsu benefits.

The technique and benefits of self-massage are described by Fan Ya-Li in "Chinese Self-Massage Therapy—The Easy Way to Health", Blue Poppy Press, Boulder, Colo., 1997. Chapter 2 deals with self-massage of the head, face, eyes, nose and ears for treating symptoms of eye related problems, ear health, neck pain and headache. The present invention allows self-massage of the head areas when the head is rolled side to side on elastomeric cushions.

Pillows are generally used to support the weight of the head over the largest area possible to reduce pressure and avoid "lumps" which result in localized high pressure discomfort. A variety of head and neck supports appear in the art to provide improved support, align the head or provide acupressure to the back of the head.

Norriss in U.S. Pat. No. 3,574,397 shows a pillow with contours and cutouts for improved neck and head support. DeLaittre et al. in U.S. Pat. No. 3,829,917 and Tatum in U.S. Pat. No. 5,457,832 show elongate head and neck pillow support for side and back body positions. Thomas in U.S. Pat. No. 4,660,239 offers a pillow with tubular neck support. Beier in U.S. Pat. No. 4,756,035 and Davis in U.S. Pat. No. 5,682,633 show a pillow for head and neck support with variable stiffness. Summer in U.S. Pat. No. 4,768,246 shows contours of resilient material for head and neck support. Rothbard in U.S. Pat. No. 4,899,405 offers a head and neck support pillow with neck bolsters. Genis in U.S. Pat. No. 5,257,429 and Von Ohlen in U.S. Pat. No. 5,615,432 show U-shaped neck and headrest pillows.

Another group of head and neck support apparatus add additional features to maintain head alignment. Clank in U.S. Pat. No. 4,914,763 adds runners under the pillow to prevent head tilt. Summer in U.S. Pat. No. 5,025,518 adds wedges to prevent head tilt. Austin in U.S. Pat. No. 5,360,017 adds lateral blocks to prevent head tilt. Popitz in U.S. Pat. No. 4,918,774 provides contours on head and neck support apparatus for airway management. Latorre in U.S. Pat. No. 4,850,067 focuses on neck and shoulder support to minimize snoring. Priolo et al. in U.S. Pat. No. 5,708,999 shows an adjustable elongate pillow for head and neck support.

Fishbane in U.S. Pat. No. 5,630,651 provides lateral bolsters to prevent head tilt in an adjustable cervical pillow with head support. Keilhauer in U.S. Pat. No. 5,727,267 and Hannouche in U.S. Pat. No. 4,424,599 provide for head, neck and upper back support. Tinhorn in U.S. Pat. No. 5,813,065 shows a contoured pillow for head and neck support with music. Price in U.S. Pat. No. 4,285,081 and Wray in U.S. Pat. No. 5,129,705 show headrests with deep contoured side elements for head alignment.

Another group of apparatus are intended to present acupressure probes to various portions of the body. Burk in U.S. Pat. No. 5,481,771 offers a neck and head support where the head support is comprised of two hemispherically shaped probes contacting on either side of the head to apply acupressure at the two pressure points at the back of the head to eliminate tension. Stone in U.S. Pat. No. 5,569,166 provides probes to contact the back of the head for acupressure with vibrations and electric stimulation. Glover in U.S. Pat. No. 5,713,816 provides head and neck support with acupressure on the spine as a neck exerciser. None of the acupressure probes above are suitable for back, frontal and side body positions.

An assortment of acupressure applicators may be found in the art such as Strumor in U.S. Pat. No. 5,607,749 which have a plurality of probes. Mencher-Aliazzo in U.S. Pat. No. 5,779,652 uses a plurality of balls as acupressure probes. Ioan in U.S. Pat. No. 5,792,174 provides a skull cap to apply acupressure. Jacobs in U.S. Pat. No. 4,574,787 offers a flexible membrane with vibrating fluid as an acupressure apparatus. Isaacson in U.S. Pat. No. 4,479,495 provides a collar as an acupressure stimulator. Sun et al. in U.S. Pat. No. 4,319,574 shows a clamping device to apply acupressure. Lewis in U.S. Pat. Nos. 4,520,798 and 4,452,237 shows wall mounted structure for self-acupressure. Coseo in U.S. Pat. No. 5,545,177 offers a framework to support the body having multiple acupressure probes.

None of the above pillows or head supports provide acupressure to more than a small area of the head. There remains a need for a head support apparatus that can provide both acupressure and shiatsu to different parts of the head as the body assumes back, side or frontal positions. There also remains a need for a head support apparatus that can provide self-massage benefits when the head is rolled side to side in back, side or frontal body positions. There remains a further need for an acupressure and shiatsu head support apparatus that is adjustable.

SUMMARY OF THE INVENTION

The present invention relates to a cradle apparatus configured to support the head in several head orientations as determined by back, side or frontal positions of the body. The most effective use of the head cradle for therapeutic benefits occurs in the prone body positions. However, the head cradle can also be effective as a headrest with the body inclined such as in a seated position with the cradle placed between the head and seat back.

In the preferred embodiment, the head cradle is composed of two lateral support members oriented generally in-line with the body and constructed of round tubular polymeric rigid material. Each lateral support member is covered with two layers of flexible elastomeric material as a cushion means. Each layer has a different density where the outer layer is softer and less firm than the inner layer. This combination provides a softer tactile feel to the skin while maintaining sufficient spring to apply acupressure and shiatsu pressure. Further, this combination of dual density cushion layers provides a means for Chinese self-massage when the head is rolled side to side.

The two lateral supports are connected by a tubular transverse support member that is threaded into each lateral support member. To adjust the distance between the pair of lateral supports, one lateral support is rotated relative to the other when the same thread hand is used as a means for adjustment. Alternately, a left hand and right hand thread combination would allow an alternate means for adjustment by turning the transverse support member. Of course, other means for adjustment mechanism may also be used.

The head cradle is placed upon a comfortable prone surface, such as a bed, with the transverse support member extended beyond the head with the lateral support members in general alignment with the prone body. With the body laying upon the back, the head will be supported solely by contact with the pair of lateral support members. The neck is free to self-align without pressure from a neck support. In this position, the lateral supports apply acupressure to the pair of pressure points at the base of the skull and shiatsu pressure is applied to the back of the head, both resulting from the weight of the head being localized upon the contact area of the head cradle. These pressure points relate to fear control, lightheadedness, nasal congestion, nosebleed and headache according to James Roy Holliday, III. The shiatsu pressure on the back of the head will reduce stress and fatigue according to Michael Reed Gach.

With the body on it's side, the side of the head is then supported by the pair of lateral supports wherein one lateral support member can apply acupressure to the pressure point behind the ear. Acupressure at this pressure point is helpful with Lumbago according to James Roy Holliday, III. The shiatsu pressure supplied by the second lateral support member can reduce insomnia to encourage sleep according to Michael Reed Gach.

With the body frontal to the bed surface, several positions are available for the head on the head cradle. With the head fully face down, the lateral support members exert acupressure upon the pressure points in the eyebrow area. These pressure points can be used to relieve some of the symptoms of cold and influenza, sinus problems, sneezing, allergies, eye discomfort and general backache according to James Roy Holliday, III. With the head at an angle to the bed surface, one lateral support member can be used to apply acupressure to the pressure point along side the nose while the other lateral support member supports the side of the head with shiatsu pressure. Application of acupressure to these pressure points is considered to be helpful with sinus problems, nasal congestion, colds and influenza according to James Roy Holliday, III. Shiatsu pressure applied to the side of the head is helpful with insomnia and encourages sleep according to Michael Reed Gach.

In an alternate embodiment, the lateral support members can have triangular shaped cross sections as well as other irregular shapes.

In another alternate embodiment, a pillow is inserted between the head and the lateral support members. The pillow will soften the acupressure and shiatsu pressure to permit longer contact time with the head cradle. Benefits occur over a longer period of time.

In another embodiment, a second transverse member connects the free ends of the lateral support members for a more rigid framework. Each traverse support member has a left hand and right hand thread as means for adjustment, allowing the transverse members to be rotated to adjust the predetermined distance between the lateral support members. At least one of the transverse support members is covered with a cushion material for neck support.

In another embodiment, magnets are inserted within the tubular lateral support members to provide magnetic therapy as well as acupressure, shiatsu and self-massage for additional benefits. The magnets can be permanent magnets or electrically controlled as means for magnetic therapy.

In yet another embodiment, a stereo sound system can be added with speakers or vibrators inserted within the lateral side supports and a sound generator placed in the transverse support member as means for sound therapy as well as acupressure, shiatsu and self-massage benefits. The means for sound therapy can produce vibrations that can also be felt by the user.

In summary, the head cradle offers the user the benefits of both acupressure and shiatsu as applied to the head pressure points by the head cradle lateral support members. Since the lateral supports and transverse support compose a rigid structure, pressure is maintained to localized areas of the head until the user changes position of the head. The elastomeric material covering the lateral support members allow self-massage of the contact areas by rotating the head to transfer the weight of the head from one to the other lateral support members in a cyclic manner. Prior art apparatus for acupressure does not address all five pressure points of the head combined with benefits from shiatsu pressure and Chinese self-massage.

DETAILED DESCRIPTION OF THE EMBODIMENTS

Figure 1:
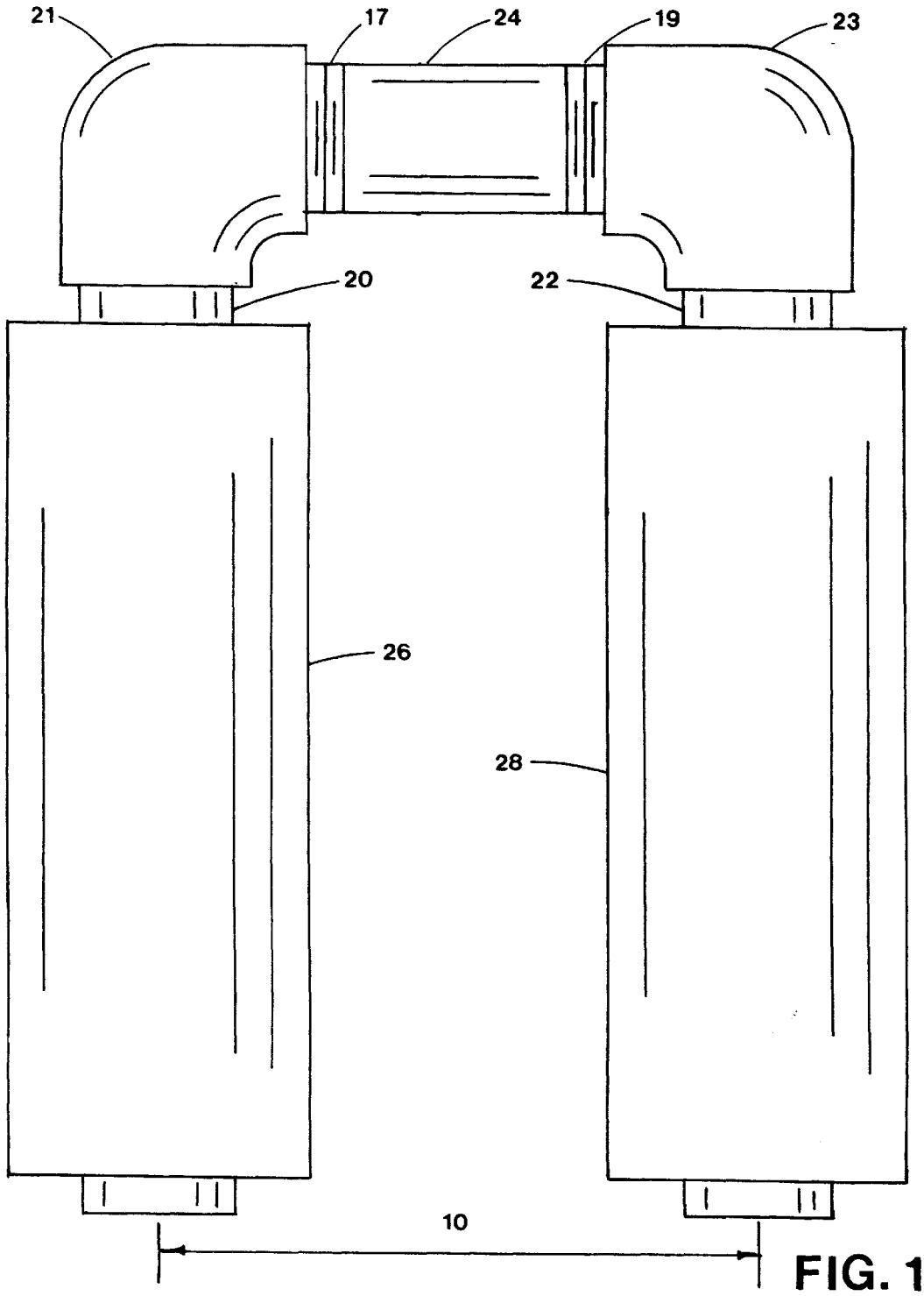
FIG. 1 is a top view of the preferred embodiment constructed in accordance with the present invention.
Figure 2:
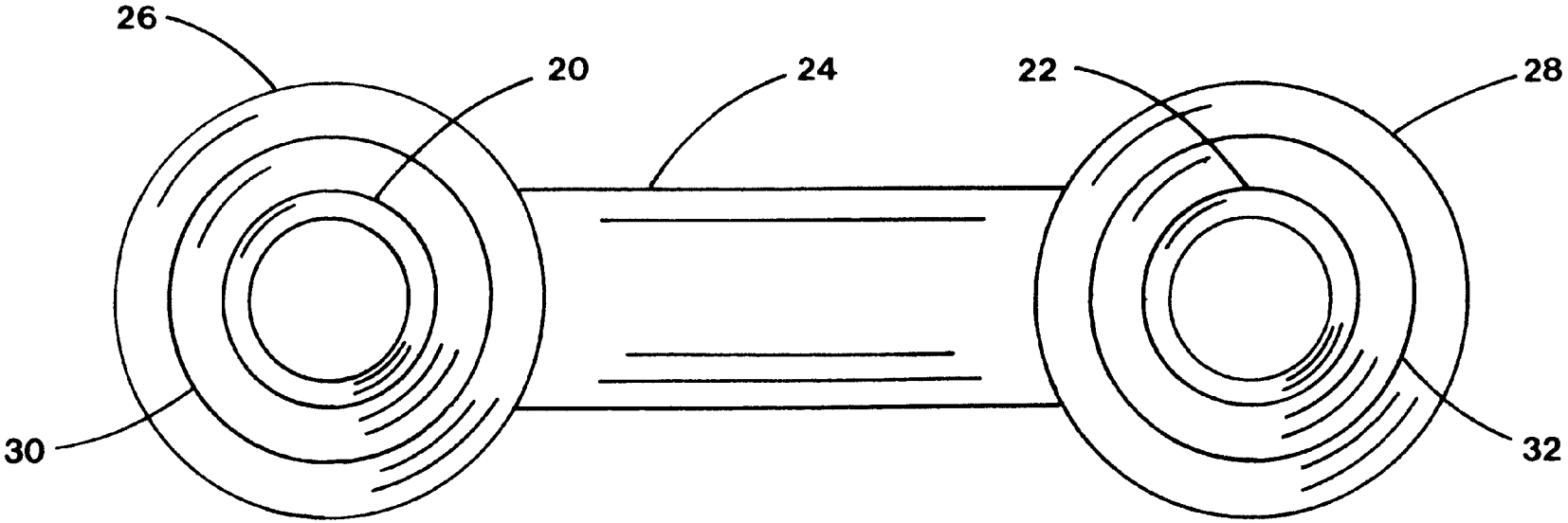
FIG. 2 is an end view of the preferred embodiment shown in FIG. 1.

Referring to the drawings in detail, lateral support members 20,22 are shown in FIGS. 1 and 2 having round tubular cross sections and are positioned generally side by side spaced by predetermined distance 10. One end of each lateral support member 20,22 is connected to elbows 21,23 which are connected by transverse support member 24, collectively forming a U-shape. Transverse support member 24 is round with threads 17,19 as a means for adjustment at each end which thread into elbows 21,23. Predetermined distance 10 may be changed by rotating one lateral support member 20 relative to the other lateral support member 22 when threads 17,19 are the same thread hand. When threads 17 and 19 are opposite hand threads, transverse support member 24 may be rotated to change predetermined distance 10 as an alternate means for adjustment. Of course it is understood that other means for adjustment may also be used such as telescoping members with locking device (not shown).

Lateral support members 20,22 are covered with an inner cushion layer 30,32 of elastomeric material and outer cushion layer 26,28 of a different density elastomeric material. Outer cushions 26,28 are softer and compress with less force than inner cushions 30,32. Non-elastomeric cushions could also be used but would be less effective for rolling the head side to side for Chinese massage.

Figure 3:
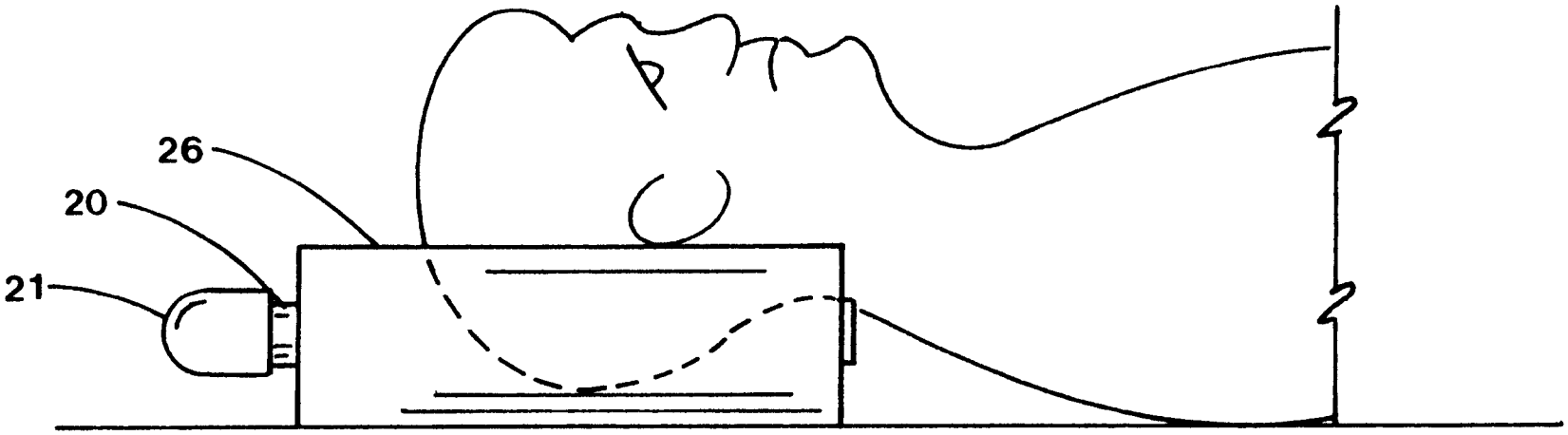
FIG. 3 is a side view with the body in a prone position of the preferred embodiment shown in FIG. 1.
Figure 4:
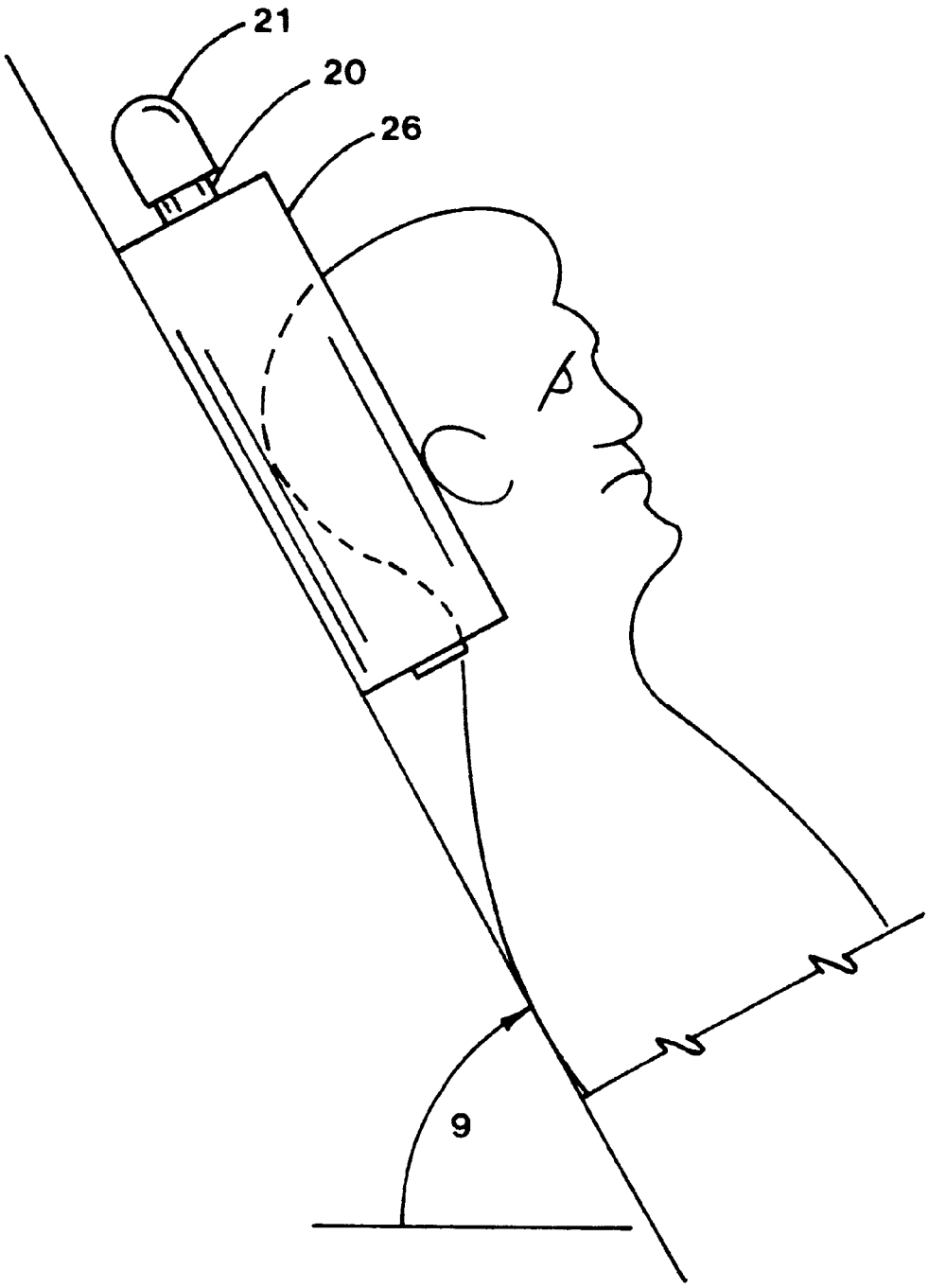
FIG. 4 is a side view with the body in an inclined position of the preferred embodiment shown in FIG. 1.

The head cradle of FIGS. 1 and 2 is shown in FIG. 3 oriented in-line with the prone body of the user. Cushions 26 and 28 contact the back of the head to support the weight. FIG. 4 shows the head cradle of FIGS. 1 and 2 being used as a head rest with the body inclined at angle 9.

Figure 5:
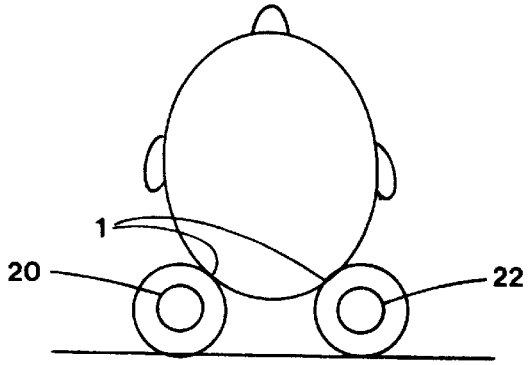
FIG. 5 is an end view of the preferred embodiment of FIG. 1 having different head positions A–E.
Figure 5:
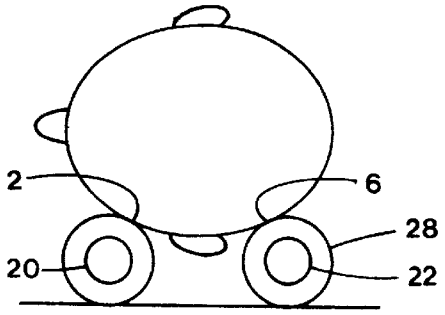
Figure 5:
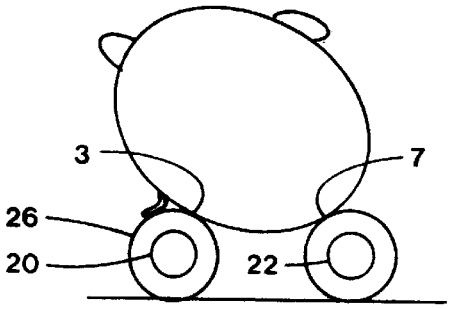
Figure 5:
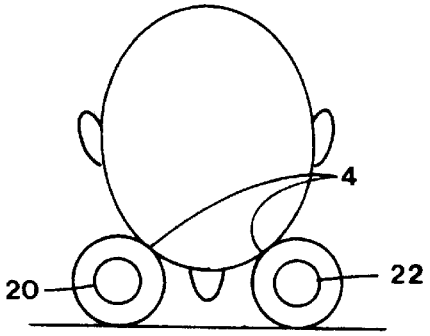
Figure 5:
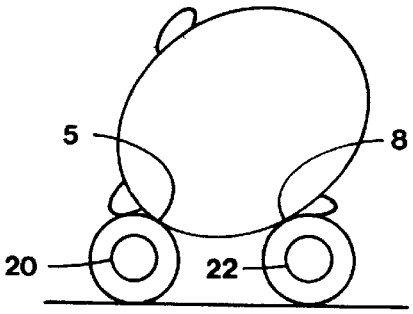

FIG. 5 shows the different head positions A–E for the preferred embodiment of FIG. 2. Head position A has the back of the head in acupressure contact with lateral support members 20,22 at the first pair of pressure points 1. Head position B shows lateral support members 20 and 22 in shiatou pressure contact with the temple 2 and the side 6 of the head. Head position C has lateral support member 20 in acupressure contact with the second pressure point 3 behind the ear and lateral support member 22 in shiatsu pressure contact with the rear portion 7 of the head. Head position D has the head in a frontal posture where the lateral support members 20 and 22 provide acupressure to the forth pressure point area 4 in the middle eyebrow. Head position E has the head angled with the side of the nose and eyebrow in contact 5 with lateral support member 20. Acupressure is applied to the third pressure point at the side of the nose and to the fourth pressure point at the inner eyebrow. Lateral support member 22 is in shiatsu contact 8 with the temple of the head. In all of these head positions A–E, the head may be rolled side to side to vary the contact time for any pressure point to apply Chinese massage.

Figure 6:
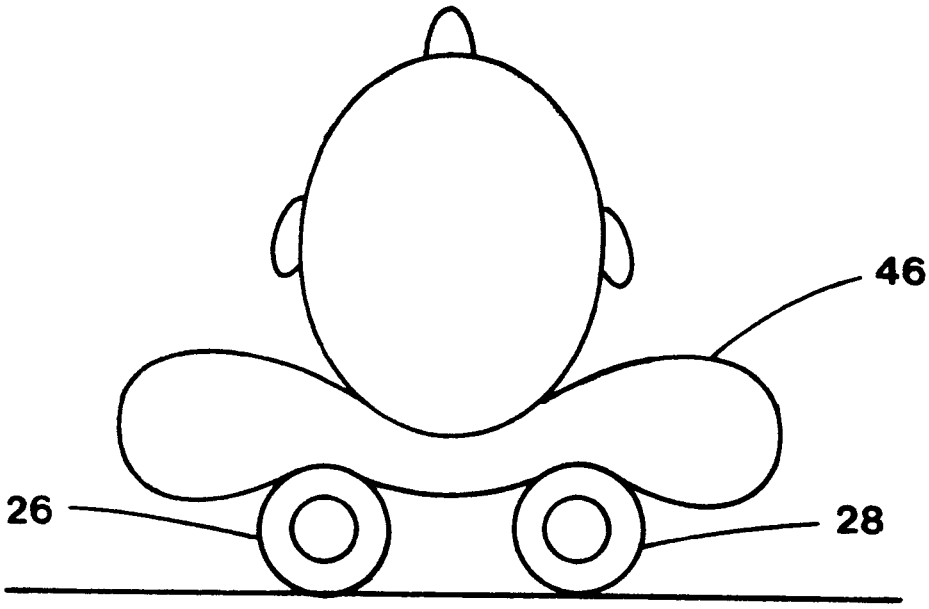
FIG. 6 is an end view of the preferred embodiment shown in FIG. 5A with a pillow inserted between the head and cradle support.

FIG. 6 shows pillow 46 inserted between the head and cushions 26,26 which cover lateral support members 20,22 for head position A. The pillow may be used for any head position A–E which tends to provide shiatsu pressure allowing longer contact time. A pillow may be used with only one lateral support 20 or 22.

Figure 7:
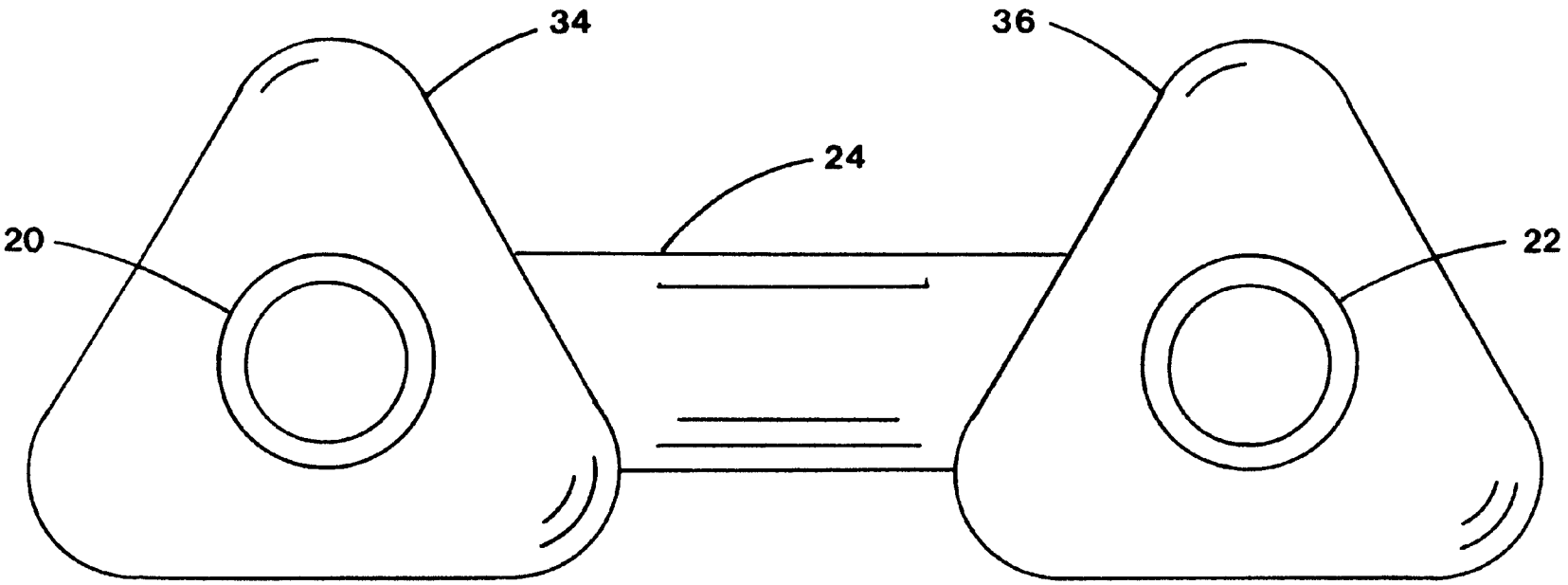
FIG. 7 is an end view of an alternate embodiment having triangular shaped head cushions.

An alternate embodiment is shown in FIG. 7 where triangular elastomeric cushions 34,36 cover lateral supports 20,22. A combination of round 26 and triangular 36 cushion shapes may also be used.

Figure 8:
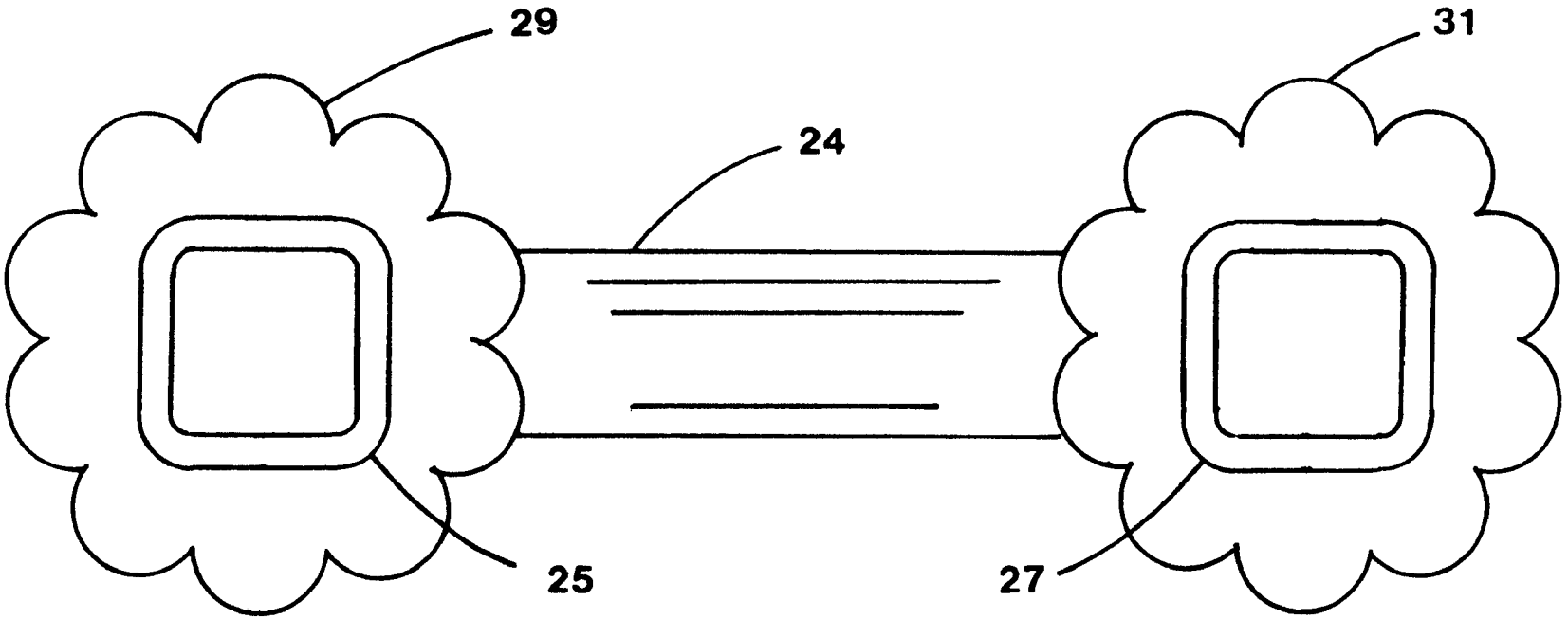
FIG. 8 is an end view of another alternate embodiment having irregular shaped head cushions.

Another alternate embodiment is shown in FIG. 8 having rectangular lateral support members 25,27 covered with irregular shaped cushions 29,31. It is understood that other shapes for cushions and lateral support members in various combinations may also be used effectively.

Figure 9:
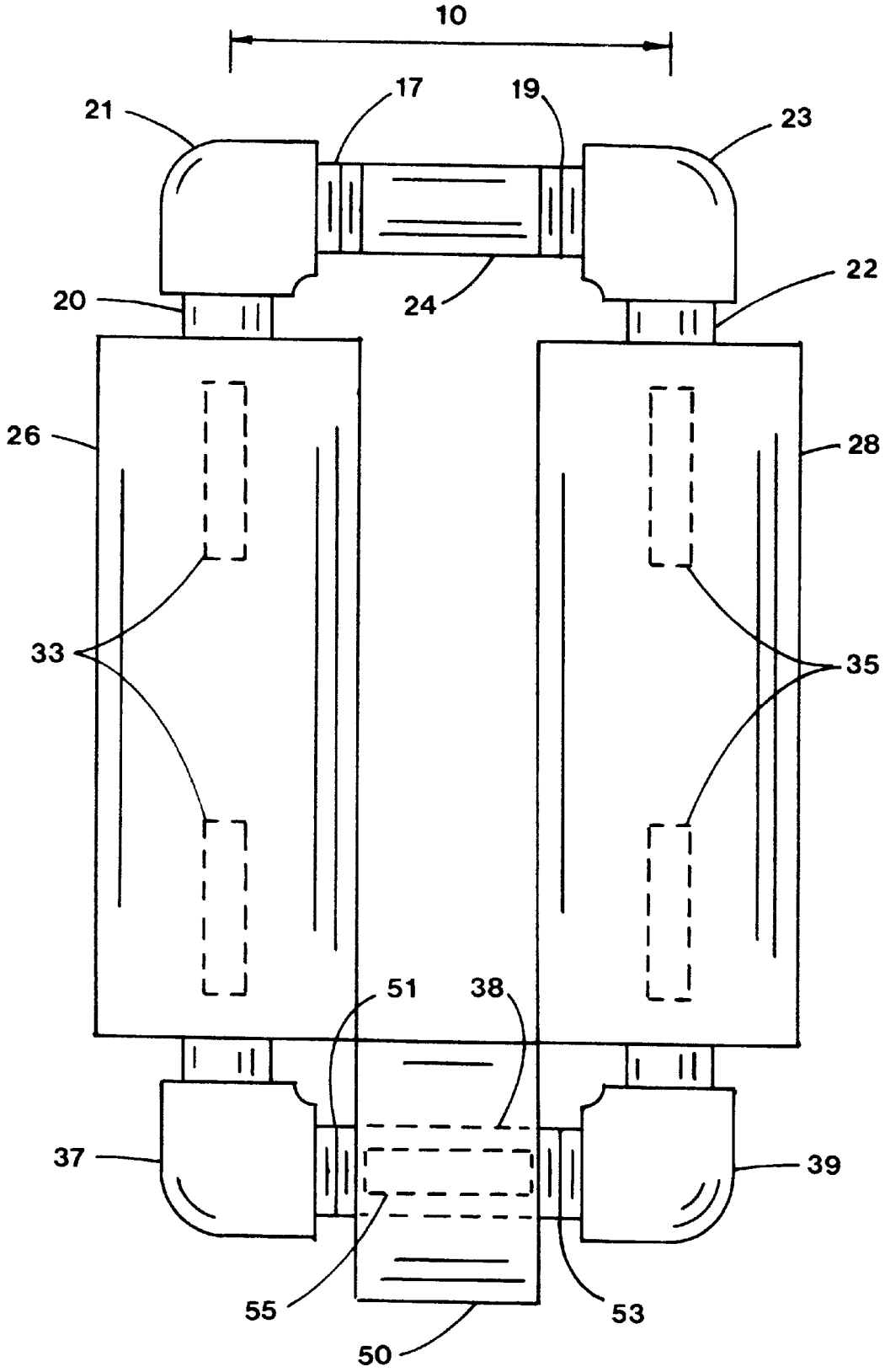
FIG. 9 is a top view of alternate embodiment with magnetic therapy and neck support.

FIG. 9 shows an alternate embodiment having a second transverse support member 38 threaded into elbows 37 and 39 which are attached to lateral support members 20,22. Cushion 50 covers transverse support member 38 for neck support. Transverse members 24 and 38 each have left hand 17,51 and right hand 19,53 threads on one end as means for adjustment. Adjustment of the predetermined distance 10 occurs when the transverse support members 24,38 are rotated. Magnets 33,35,55 have been inserted into lateral supports 20,22 and transverse support member 38 for magnetic therapy. The magnets 33,35,55 may be permanent magnet or electrically controlled from an internal or external power source (not shown).

Figure 10:
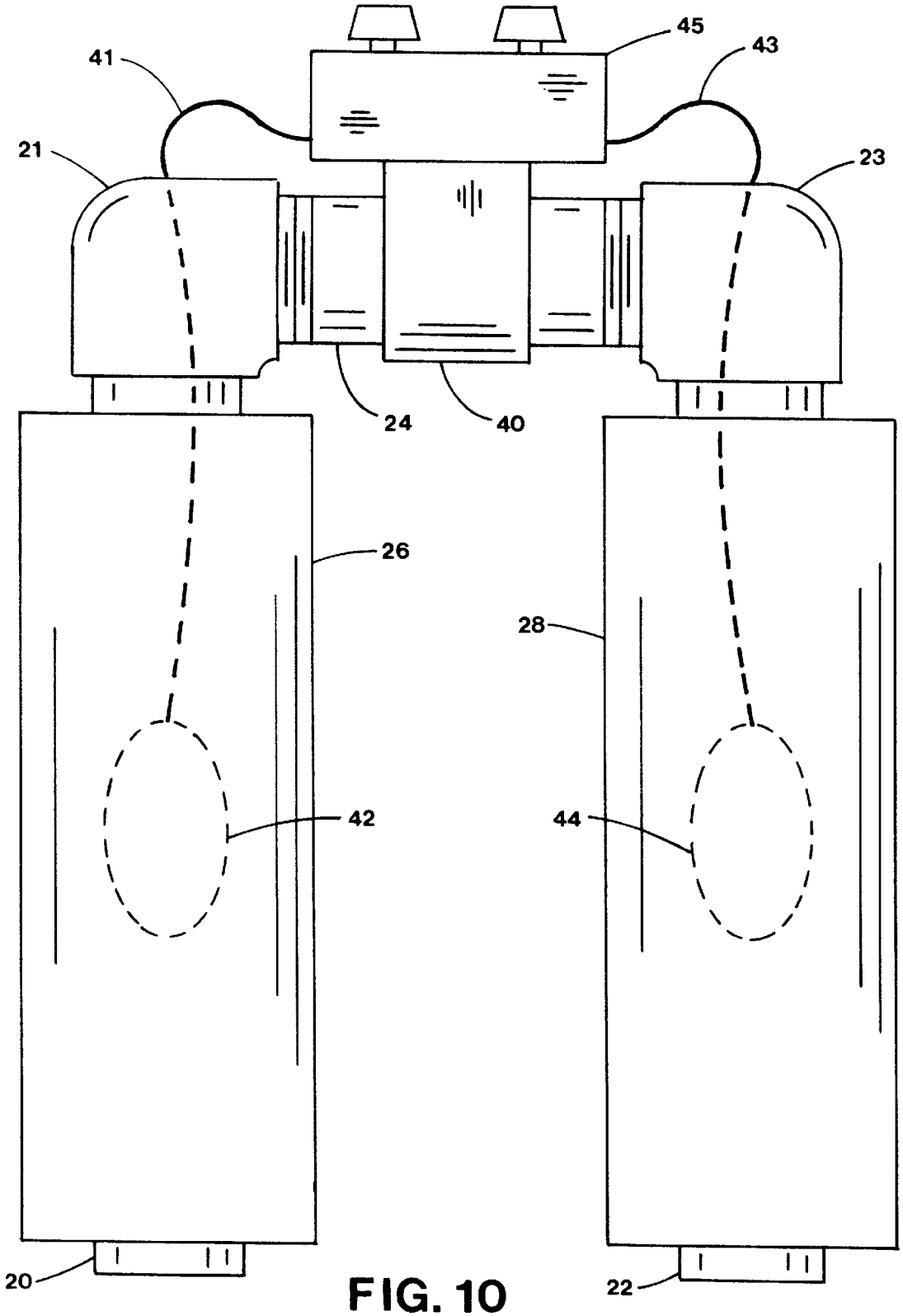
FIG. 10 is a top view of alternate embodiment having stereo sound speakers/vibrators.

Another alternate embodiment is shown in FIG. 10 having stereo sound system added to the preferred embodiment with speakers/vibrators 42,44 as means for sound and/or vibrations inserted into lateral support members 20,22. The sound/vibration control 45 is attached to traverse support member 24 by control bracket 40 which allows transverse support member 24 to rotate for adjustment. Wires 41,43 connect speakers 42,44 to sound/vibration control 45. Various sound and vibration generators such as radio, tape, CD, integrated chip, etc. may be part of sound/vibration control 45 as means to produce sound and vibrations. An electrical power supply such as batteries (not shown) are attached to the control bracket 40. An external power source and external sound/vibration control may also be used.

The improvement of the present invention over prior art lies in the versatility of the head cradle to administer acupressure contact with all five of the pressure point areas of the head depending upon head placement on the cradle. Shiatsu pressure is also applied to pressure points as well as to other areas of the head. Rolling the head side to side to alternately deform the elastomeric cushions provides Chinese massage. The adjustment means allows the lateral support members to be positioned at a preferred distance by the user.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. A head cradle comprising:

a pair of lateral support members, said lateral support members configured to support the head of the body in more than one position;

a means to connect said lateral support members to maintain a predetermined distance between said lateral support members;

a cushion, said cushion being composed of dual density elastomeric material to cover said lateral support members;

said lateral support members positioned relative to said head of a user whereby said lateral support members bear the weight of said head.

2. The head cradle according to claim 1 further comprising a pillow, said pillow being in contact with a portion of said head and said cushion to reduce contact pressure.

3. The head cradle according to claim 1 wherein said lateral support members are composed of tubular material having a round cross section.

4. The head cradle according to claim 1 further comprising a means to adjust said predetermined distance between said lateral support members whereby said lateral support members remain parallel as said predetermined distance changes.

5. The head cradle according to claim 4 wherein said means to adjust said predetermined distance between said lateral support members further comprises a threaded component as said means to connect said lateral support members.

6. The head cradle according to claim 1 wherein said cushion means have an irregular surface whereby said irregular surface contacts a portion of the head of the user.

7. The head cradle according to claim 1 wherein said cushion comprises said dual density elastomeric material having a softer outer layer in contact with the skin and a firmer inner layer suitable to apply pressure to said head.

8. A therapeutic head support comprising:

a pair of lateral support members, said lateral support members configured to support the head of the body;

a means to connect said lateral support members to maintain a predetermined distance between said lateral support members;

a cushion, said cushion covering said lateral support members with elastomeric material;

an adjustment means, said adjustment means configured between said lateral supports to change said predetermined distance;

said lateral support members positioned relative to said head of a user whereby said lateral support members remain generally parallel when said predetermined distance is changed.

9. The therapeutic head support according to claim 8 wherein said cushion further comprises a dual density elastomeric material, said dual density elastomeric material covering said lateral support members.

10. The therapeutic head support according to claim 8 further comprising a pillow means, said pillow means inserted between said head and said cushions to support a portion of said head.

11. A head cradle comprising:

a pair of lateral support members, said lateral support members configured to support the head of the body;

a means to connect said lateral support members to maintain a predetermined distance between said lateral support members;

a cushion, said cushion covering said lateral support members with elastomeric material;

a means for magnetic therapy, said means for magnetic therapy positioned internal to said lateral support members;

said lateral support members positioned relative to said head of a user whereby said lateral support members allow said head to be rolled side to side to achieve self-massage for that portion of said head in contact with said lateral support members.

12. The head cradle according to claim 11 further comprising a means to adjust said predetermined distance between said lateral support members.

13. The head cradle according to claim 11 wherein said head cradle is configured to be reversible whereby said head may contact any side of said cushion means.

14. The head cradle according to claim 11 wherein said head cradle is configured to be reversible whereby said head may contact any side of said cushion.

* * * * *